US008119892B2

(12) United States Patent
Leach et al.

(10) Patent No.: US 8,119,892 B2
(45) Date of Patent: Feb. 21, 2012

(54) LATCH FOR TRAVEL GUITAR WITH HINGED NECK

(75) Inventors: Harvey Leach, Cedar Ridge, CA (US); Adrian Bagale, Marshall, MI (US)

(73) Assignee: Voyage-Air Guitar Inc., Livermore, CA (US)

( * ) Notice: Subject to any disclaimer, the term of this patent is extended or adjusted under 35 U.S.C. 154(b) by 55 days.

(21) Appl. No.: 12/817,882

(22) Filed: Jun. 17, 2010

(65) Prior Publication Data

US 2011/0308373 A1 Dec. 22, 2011

(51) Int. Cl.
*G10D 13/02* (2006.01)

(52) U.S. Cl. ..... 84/293; 84/267; 84/291

(58) Field of Classification Search ..... 84/290, 84/291, 293, 267
See application file for complete search history.

(56) References Cited

U.S. PATENT DOCUMENTS 7,579,535 B2 * 8/2009 Pyper-Scott ..... 84/293
7,705,224 B1 * 4/2010 Ward ..... 84/267

* cited by examiner

*Primary Examiner* — Kimberly Lockett
(74) *Attorney, Agent, or Firm* — Handal & Morofsky, LLC

(57) ABSTRACT

A folding guitar comprising a guitar body and guitar neck is disclosed. A hinge connects the guitar body to the guitar neck. The hinge is disposed on one side of the guitar body and guitar neck. A latch plate is secured to the other side of one of the guitar body or guitar neck. A catch member is secured to the other side of the other one of the guitar body or guitar neck. The catch member defines a catch member catch surface. A latch arm is pivotally mounted to the latch plate. A hitch arm is pivotally mounted to the latch arm. A securement member mounted on the hitch arm, the securement member think configured to engage the catch member catch surface. The latch arm, hitch arm and latch plate are configured to vary the distance between the securement member and the catch member catch surface.

1 Claim, 8 Drawing Sheets

Figure 1
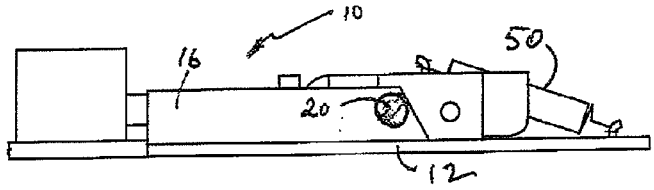
Figure 2
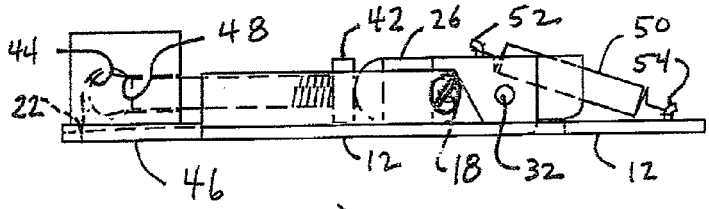
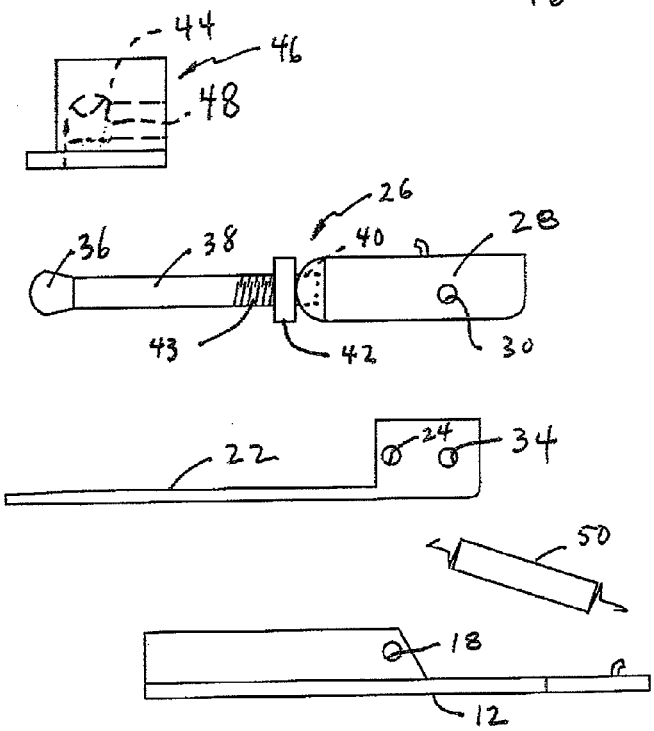
Figure 3
Figure 4
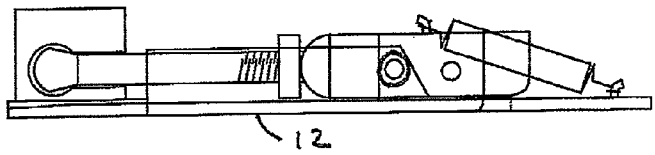

LATCH FOR TRAVEL GUITAR WITH HINGED NECK

TECHNICAL FIELD

The invention relates to a latch for locking the neck of a hinged neck traveling guitar in place.

CROSS REFERENCE TO RELATED APPLICATIONS (Not applicable)

STATEMENT REGARDING FEDERALLY SPONSORED RESEARCH OR DEVELOPMENT (Not applicable)

BACKGROUND OF THE INVENTION

The manufacture of note producing musical instruments began as a search for the mechanical equivalent of the human voice. This in fact remained the standard through the Middle Ages and into the Renaissance and the early modern period.

Stringed instruments have been known since ancient times. These included such instruments as the lute, a guitar-like instrument with a sound box and fingerboard. A New Kingdom (ancient Egypt, 1380 BC) bronze in the collection of the Metropolitan Museum of Art depicts a dancing Nubian raised on his toes with one knee cocked, left hand high working a fingerboard and right hand plucking the strings in a pose which might be illustrative of a modern rock musician.

But the lute has a much more ancient history, perhaps originating with West Semitic nomadic people who brought the instrument to Mesopotamia, where the archaeological record includes representations dating back to the Akkadian period (2350 to 2170 B.C.), being introduced to the Egyptians, perhaps at the end of the Middle Kingdom Hyksos dynasties (XV to XVII dynasty, 1730 to 1580 B.C.).

In more recent times, stringed lute-like musical instruments continue to be among the most popular instruments. Folk artists throughout the United States have used the guitar, sometimes one of the homemade varieties, in a wide range of musical genres including blues, bluegrass, and so forth.

In contrast to percussive instrumentation, the need for amplification of the relatively weak sounds of strings, reeds, and vibrating human lips presented challenges to early musical instrument manufacturers. These challenges were met primarily by resonant systems that mechanically concentrate, and output musical sound. There is a demanding standard in the stability of the instrument if high-quality sound is to be produced.

Moreover, over the years, artists playing acoustic stringed instruments have introduced a wide variety of playing techniques into the music surrounding these instruments. While, perhaps, the ancients only plucked the strings of the lute to achieve a musical tone which gradually decayed, later artists used the bow to produce notes of relatively constant and somewhat controllable amplitude. Modern artists employ a variety of techniques in their performances. Acoustic blues performers may rap their instruments with fingertips, palms or knuckles. Certain violin compositions, typically played by having a horsehair bundle slide across the strings, also call for the strings to be plucked. This results in yet greater demands being put on the mechanical stability of the instrument.

Given the popularity of stringed musical instruments, especially the guitar, people often take them along when traveling.

However, they are bulky and poorly suited to convenient transport. They are unlikely to fit into airlines stowaway spaces or under airline seats. In response to this need, guitars with folding necks have been proposed. See for example my earlier U.S. Design Pat. No. 516,114, and my earlier pending U.S. patent application Ser. No. 11/640,095, filed Dec. 15, 2006. While this instrument is effective, it is difficult to make requiring significant handwork and fine tuning.

In order for a hinged neck traveling guitar to be used, one must employ a latch to hold the neck in the playing position after the neck has been moved from the travel or storage position to the playing position by rotation of the neck about the hinge. This latch should be easy to use and at the same time positively lock the neck in the proper position, or the acoustics of the guitar will be degraded.

SUMMARY OF THE INVENTION

In accordance with the invention, a latch is provided which is easy to use, requiring only that the user insert a ball-terminated arms in a catch and rotate a lever.

The inventive folding guitar comprises a guitar body and guitar neck. A hinge connects the guitar body to the guitar neck. The hinge is disposed on one side of the guitar body and guitar neck. A latch plate is secured to the other side of one of the guitar body or guitar neck. A catch member is secured to the other side of the other one of the guitar body or guitar neck. The catch member defines a catch member catch surface. A latch arm is pivotally mounted to the latch plate. A hitch arm is pivotally mounted to the latch arm.

A securement member mounted on the hitch arm, the securement member think configured to engage the catch member catch surface. The latch arm, hitch arm and latch plate are configured to vary the distance between the securement member and the catch member catch surface.

BRIEF DESCRIPTION OF THE DRAWINGS

The operation of the invention will become apparent from the following description taken in conjunction with the drawings, in which:

FIG. 1 is a side view generally illustrating a general implementation of the latch of the present invention;

FIG. 2 is a view similar to FIG. 1, but illustrating hidden portions of parts in phantom lines;

FIG. 3 is an exploded side plan view of the principal components of the inventive latch;

FIG. 4 is a diagrammatic side view of the components of the inventive latch similar to FIG. 2, superimposed over each other in position, but not using any hidden lines;

DETAILED DESCRIPTION OF THE PREFERRED EMBODIMENTS

Figure 5:
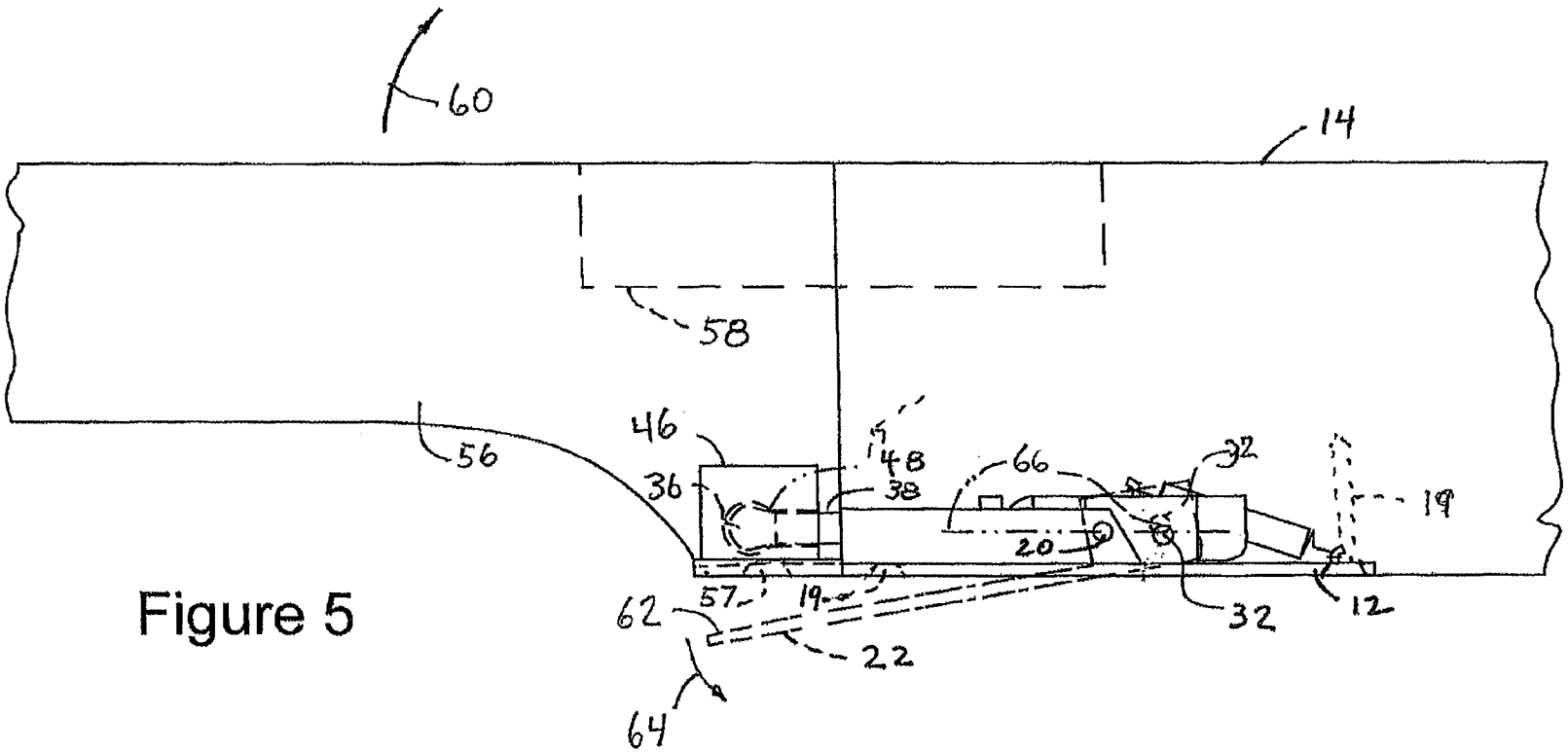
FIG. 5 illustrates operation of the inventive latch.
Figure 6:
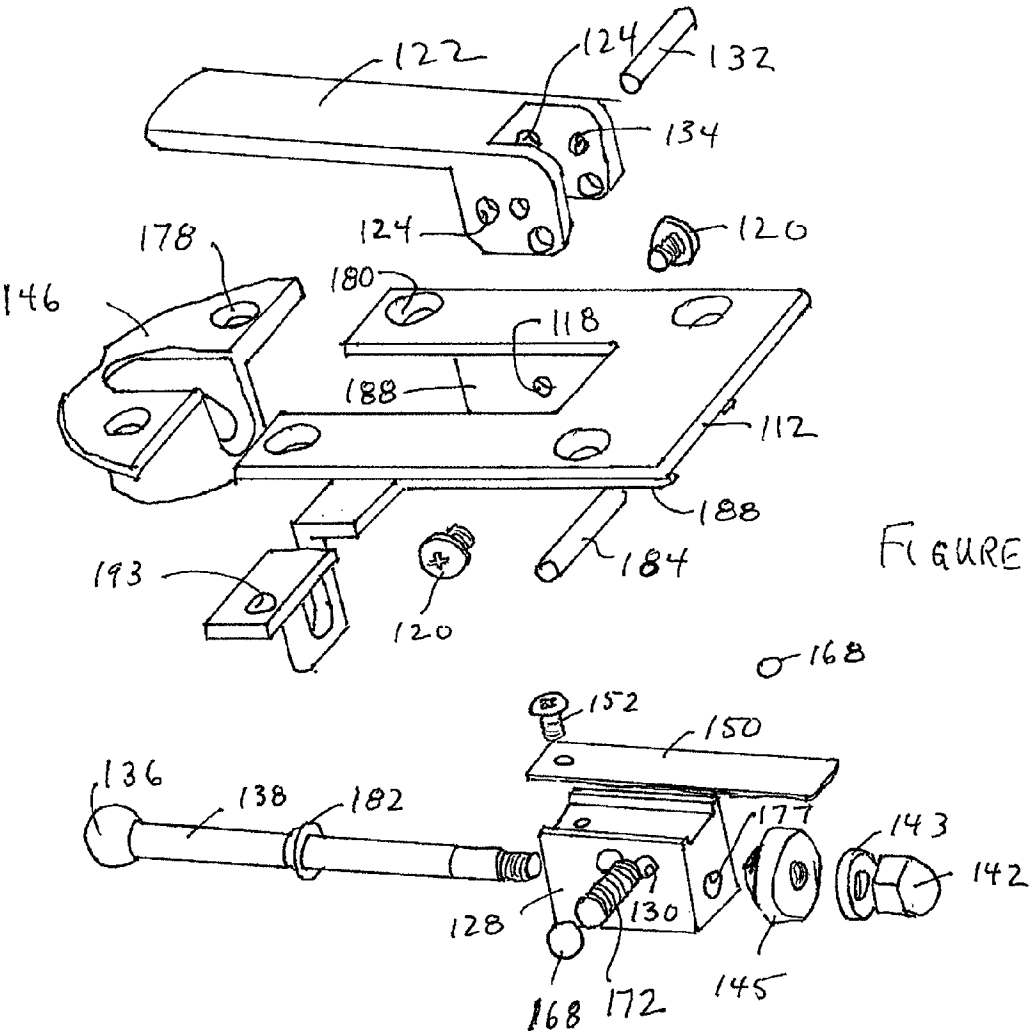
FIG. 6 illustrates another embodiment of the hinge of the present disclosure in exploded perspective.
Figure 7:
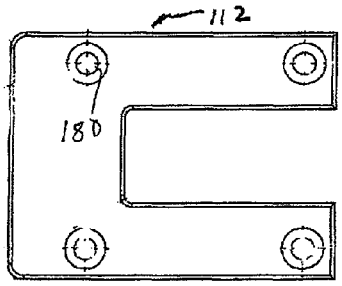
FIG. 7 is a top view of a latch plate of the hinge of FIG. 6.
Figure 10:
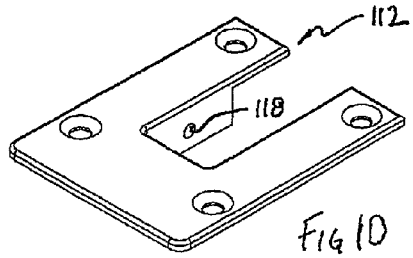
FIG. 10 is a perspective view of the latch plate of FIG. 7.
Figure 8:
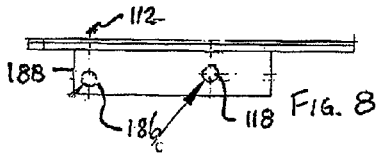
FIG. 8 is a side view of the latch plate of FIG. 7.
Figure 11:
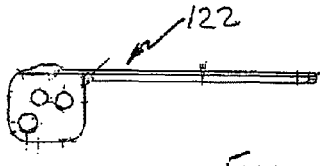
FIG. 11 is a side view of the latch arm of the hinge of FIG. 6.
Figure 9:
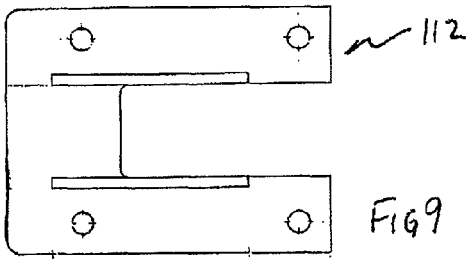
FIG. 9 is a bottom view of the latch plate of FIG. 7.
Figure 12:
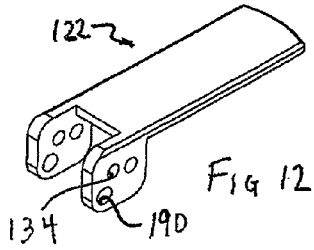
FIG. 12 is a perspective view of the latch arm of the hinge of FIG. 6.
Figure 13:
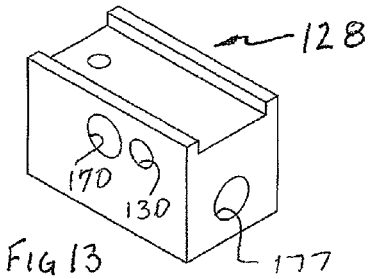
FIG. 13 is a perspective view of the hitch body of the hinge of FIG. 6.
Figure 14:
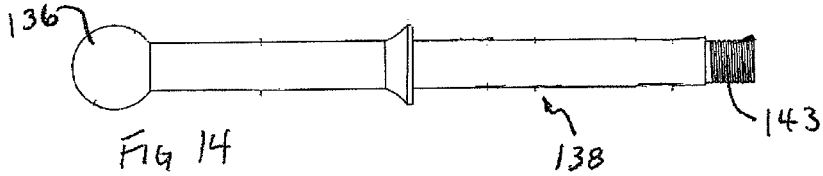
FIG. 14 is a side view of a hitch arm of the hinge of FIG. 6.
Figure 15:
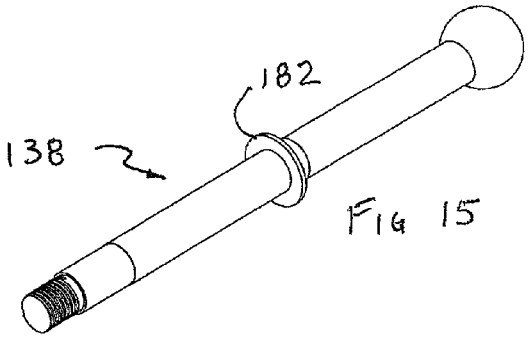
FIG. 15 is a perspective view of a hitch arm of the hinge of FIG. 6.
Figure 16:
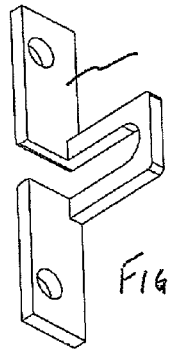
FIG. 16 is a perspective view of the guide of the hinge of FIG. 6.
Figure 17:
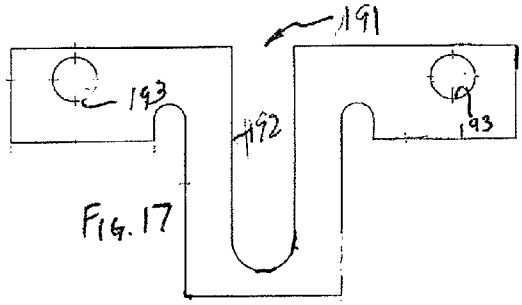
FIG. 17 is a plan view of a guide of the hinge of FIG. 6.
Figure 18:
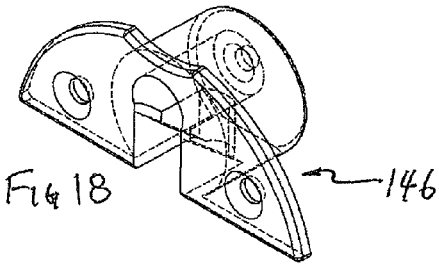
FIG. 18 is a perspective of the heel catch plate of the hinge of FIG. 6.
Figure 19:
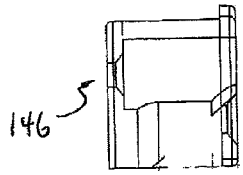
FIG. 19 is a side plan view of the heel catch plate of the hinge of FIG. 6.
Figure 20:
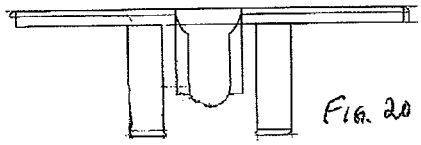
FIG. 20 is a side plan view of the heel catch plate of the hinge of FIG. 6.
Figure 21:
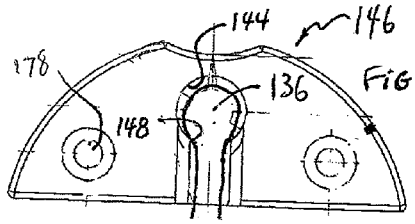
FIG. 21 is a top plan view of the heel catch plate of the hinge of FIG. 6.
Figure 23:
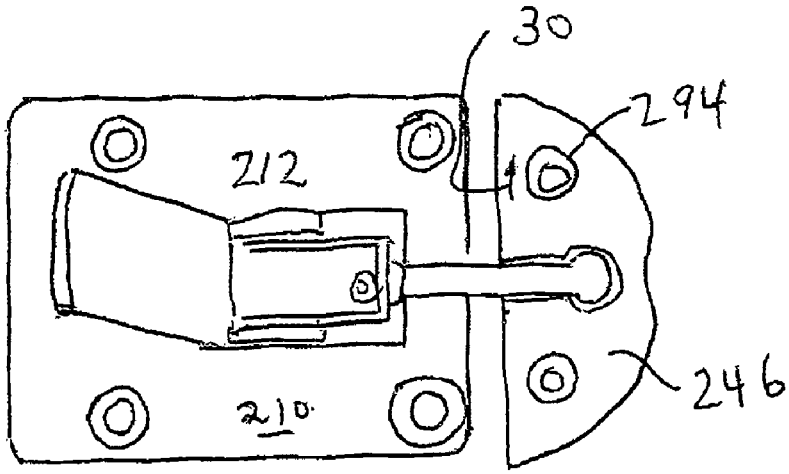
FIG. 23 is a perspective view of the hinge of FIG. 22 with the latch arm in the unlocked position.
Figure 22:
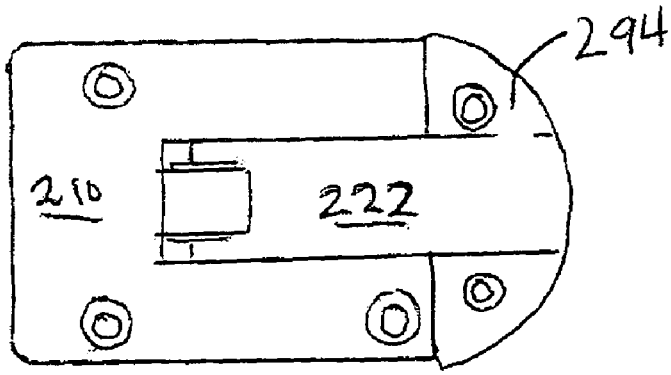
FIG. 22 is a top plan view of a third embodiment of the inventive hinge.
Figure 24:
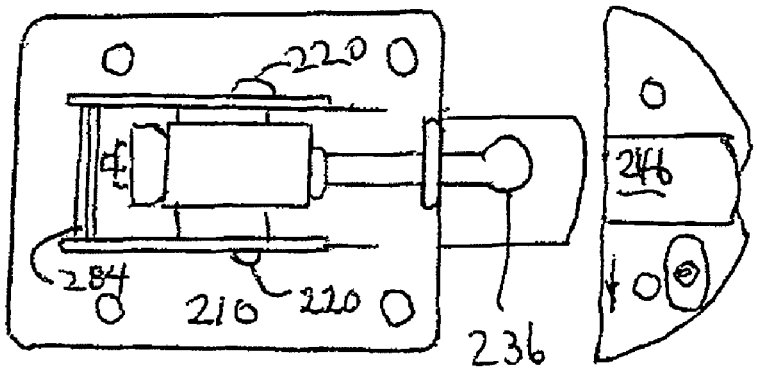
FIG. 24 is a bottom plan view of the hinge of FIG. 22.
Figure 25:
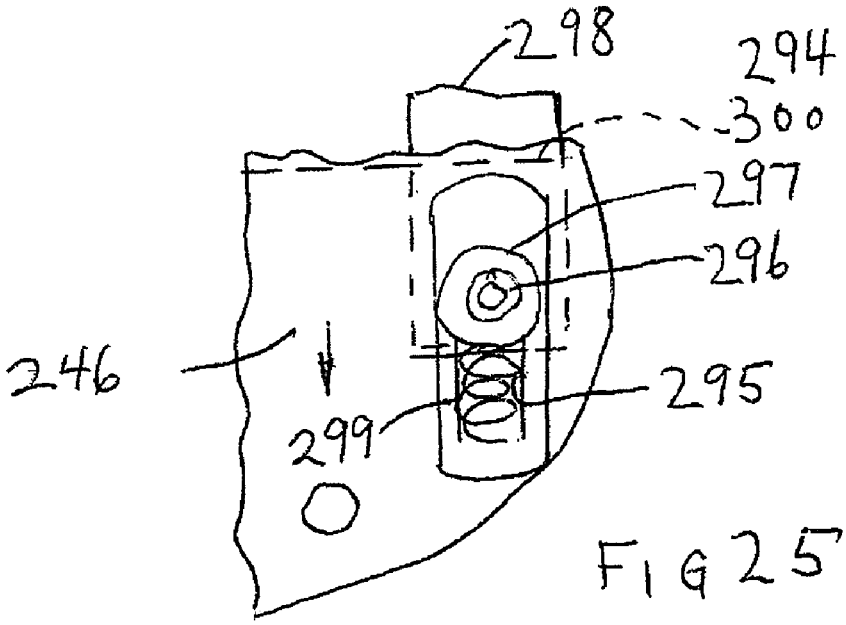
FIG. 25 is a detail of the hinge of FIG. 22.

Referring to FIGS. 1-5, and in particular initially to FIG. 1, a latch 10, constructed in accordance with the present invention is illustrated. Latch 10 comprises a guitar body base plate 12 which is secured to the body 14 of a guitar (FIG. 5) by screws 19, which are secured in holes in guitar body 14. Base plate 12 includes integral upstanding walls 16. Walls 16 include holes 18 which support short pivot pins or screws 20. Screws 20 screw into the threaded holes 18, and fit into holes 24. Latch arm 22 rotates on the end of screws 20. Thus, latch arm 22 (which includes holes 24 which receive screws 20) is rotatably mounted on pivot pin 20.

A hitch arm 26 comprises a base 28 which defines a hole 30. A pin 32 is mounted in hole 30 in hitch arm 26 and hole 34s in latch arm 22. This allows for rotational movement between hitch arm 26 and latch arm 22.

The distance by which the ball 36 is positioned with respect to the end of base 28 is adjusted by screw arm 38, by rotation of screw arm 38 which is screwed into a tapped hole 40 in base or hitch body 28. The rotary position of screw arm 38 may be locked by rotation of nut 42. Nut 42 rotates on threads 43. It is noted that threads 43 also mate with tapped hole 40.

Ball 36 engages a socket 44 in heel catch plate 46 at an arc shaped engagement surface 48. The structure of the hinge is completed by a spring 50 which is mounted in tension between a hook 52 on hitch arm 26, and a hook 54 on guitar body base plate 12.

The operation of the inventive latch may be understood from FIG. 5. In the locking position, latch 10 takes the position illustrated in the solid lines, with heel catch plate 46 mounted in folding guitar neck 56 by screws 57. If it is desired to put the guitar in the travel position, it is folded about hinge 58 in the direction of arrow 60. In order to do this, it is necessary to release latch 10. This is done by pulling latch arm 22 to the position illustrated in phantom lines in FIG. 5. This is facilitated by tapered surface 62 which allows the user to insert a fingernail to pull latch arm 22 out in the direction of arrow 64. This also allows ball 36 to be moved in the direction of arrow 64 and exit heel catch plate 46.

The operation of latch 10 is much like a Visegrips brand locking pliers. More particularly, in the position illustrated in broken lines in FIG. 5, pin 32 is relatively far from arc-shaped engagement surface 48. When the center of pin 32 passes over the center line 66 of screw 20, pin 32 is closer to engagement surface 48. It is then so close to engagement surface 48 that significant pressure is exerted between ball 36 and engagement surface 48. As pin 32 continues to the position shown in solid lines in FIG. 5, this pressure is somewhat reduced as the distance between pin 32 becomes somewhat larger again. Thus, the latch securely joins neck 56 to body 14, and is held in that position because the tension acting on screw arm 38 tends to pull neck 56 toward body 14.

Referring now to FIGS. 6-21, another embodiment of the hinge is illustrated. This embodiment operates much the same way as the embodiment of FIGS. 1-5, and analogous or corresponding parts are labeled with numbers 100 higher than the numbers of the corresponding or analogous parts in the embodiment of FIGS. 1-5.

More particularly, latch 110 comprises a latch arm 122 mounted for rotation on screws 120 which pass through tapped holes 118 in latch plate 112. The ends of screws 120 extend into holes 124 in latch arm 122 to support latch arm 122 for rotation with respect to latch plate 112.

Pin 132 is jam fitted into hole 130. The ends of pin 132 extend into and are loosely fitted to holes 134 in latch arm 122. A pair of balls 168 are received within hole 170 at opposite ends of hole 170. A coil spring 172 is held in compression between balls 168. In the position where latch arm 122 is parallel to latch plate 112 and flush with latch plate 112, balls 168 are driven toward holes 124, thus positively locking latch arm 122 in place.

A leaf spring 150 is secured to hitch body 128 by a bolt 152, which screws into hole 174 in hitch body 128. When latch arm 122 is pulled from the guitar neck to allow the guitar neck to be folded, leaf spring 150 urges ball 136 away from latch arm 122, facilitating folding of the guitar neck.

Hitch arm 138 passes through hole 177 in hitch body 128. Rubber washer 145, washer 143 and locking nut 142 are mounted on the end 176 of hitch arm 138. When latch arm 122 is flush with latch plate 112, latch arm 122 pulls the end 176 of hitch arm 138 together with rubber washer 145, washer 143 and locking nut 142 toward heel catch plate 146. Rubber washer 144 acts like a spring to apply a locking force. This results in an exertion of force without applying that force to the wood surrounding the screws which are used to secure the latch to the guitar body and neck. More particularly, screws, not illustrated, pass through holes 178 in heel catch plate 146, and holes 180 in latch plate 112.

Excess movement of hitch arm 138 is limited by skirt 182. The movement of hitch arm 138 is limited by locking cap nut 142, which when the latch is opened, is caused to bear against spring pin 184, which is mounted in holes 186 in perpendicular extensions 188 of latch plate 112.

When latch arm 122 is fully extended, holes 190 are in engagement with balls 168.

A guide 191 includes a guide surface 192 which guides the exit of hitch arm 138 from heel catch plate 146 during folding of the guitar neck. Holes 193 receive the same screws as holes 180 illustrated in FIG. 6. If desired, guide 191 and heel catch plate 146 may be cast as a single part.

Yet another embodiment of the invention is illustrated in FIGS. 22 through 25. In this embodiment, corresponding and analogous parts have been given numbers 100 higher than corresponding and analogous parts of the embodiment of FIG. 6-21.

Latch 210 comprises a latch arm 222 mounted in a latch plate 212. A ball 236 mounts in a heel catch plate 246. A sliding latch lock 294 is mounted in a slot 295, within which it slides. In the position illustrated in FIG. 22, latch lock 294 overlies latch arm 222, thus positively retaining latch arm 222 in the locked position. Rivet 296 is secured to lock 294 and maintained in slot 295 by a washer 297. This allows the end 298 of lock 294 to be driven against the force of spring 299 in the direction of arrow 301 over the edge 300 of heel catch plate 246. This allows latch arm 222 to be rotated into the unlocked position analogous to the position illustrated in broken lines in FIG. 5, thus allowing the guitar neck to be folded over the body.

While illustrative embodiments of the invention have been described, it is noted that various modifications will be apparent to those of ordinary skill in the art in view of the above description and drawings. Such modifications are within the scope of the invention which is limited and defined only by the following claims.

What is claimed:

1. A folding guitar, comprising:

(a) a guitar body;

(b) a guitar neck;

(c) a hinge connecting said guitar body to said guitar neck, said hinge being disposed on one side of said guitar body and guitar neck;

(d) a latch plate secured to the other side of one of said guitar body or guitar neck;

(e) a catch member secured to the other side of the other one of said guitar body or guitar neck, said catch member defining a catch member catch surface;

(f) a latch arm pivotally mounted to said latch plate;

(g) a hitch arm pivotally mounted to said latch arm; and (h) a securement member mounted on said hitch arm, said securement member configured to engage said catch member catch surface, said latch arm, hitch arm and latch plate being configured to vary the distance between said securement member and said catch member catch surface.

* * * * *